US009637148B2

(12) United States Patent
Jung et al.

(10) Patent No.: US 9,637,148 B2
(45) Date of Patent: May 2, 2017

(54) APPARATUS FOR ESTIMATING LATERAL FORCES OF RAILROAD VEHICLES

(71) Applicant: LSIS CO., LTD., Anyang-si, Gyeonggi-do (KR)

(72) Inventors: Jongchul Jung, Seoul (KR); Yong Gee Cho, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/601,024

(22) Filed: Jan. 20, 2015

(65) Prior Publication Data

US 2015/0210300 A1 Jul. 30, 2015

(30) Foreign Application Priority Data

Jan. 27, 2014 (KR) ..... 10-2014-0009343

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***B61L 23/04*** | (2006.01) |

(Continued)

(52) U.S. Cl.

CPC ..... *B61L 23/047* (2013.01); *B61F 9/005* (2013.01); *B61L 15/0081* (2013.01)

(58) Field of Classification Search

CPC ..... B61F 5/383

See application file for complete search history.

(56) References Cited

U.S. PATENT DOCUMENTS

2003/0182041 A1* 9/2003 Watson ..... B60R 21/0132 701/45
2004/0128060 A1* 7/2004 Park ..... B60R 21/0132 701/124
2005/0273240 A1 12/2005 Brown et al.

(Continued)

FOREIGN PATENT DOCUMENTS

CN 100352703 12/2007
CN 101417654 4/2009

(Continued)

OTHER PUBLICATIONS

The State Intellectual Property Office of the People's Republic of China Application No. 201510088778.7, Office Action dated Nov. 17, 2016, 6 pages.

*Primary Examiner* — Imran Mustafa

(74) *Attorney, Agent, or Firm* — Lee, Hong, Degerman, Kang & Waimey

(57) ABSTRACT

The present disclosure relates to an apparatus and a method for estimating a lateral force applied to a bogie due to contact between a wheel and a rail when a railroad vehicle drives in a curved section, the apparatus including: a lateral velocity estimation observer configured to calculate a lateral velocity estimate by estimating a lateral velocity based on a vertical acceleration, a lateral acceleration, a yaw velocity, and a wheel angular velocity of the railroad vehicle; and a lateral force estimation observer configured to calculate a lateral force estimate, by estimating a lateral force applied to a bogie of the railroad vehicle based on a steering angle of the railroad vehicle, a vertical force applied to the railroad vehicle, and a lateral velocity estimate calculated by the lateral velocity estimation observer.

7 Claims, 4 Drawing Sheets

(51) Int. Cl.
*B61L 15/00* (2006.01)
*B61F 9/00* (2006.01)

(56) References Cited

U.S. PATENT DOCUMENTS

| | | | | |
|---|---|---|---|---|
| 2008/0184770 | A1* | 8/2008 | Sato | G01C 19/56 73/1.37 |
| 2008/0208406 | A1* | 8/2008 | Chen | B60W 10/18 701/41 |
| 2010/0023190 | A1* | 1/2010 | Kumar | B61L 3/006 701/20 |
| 2010/0131144 | A1 | 5/2010 | Ryu et al. | |
| 2011/0233881 | A1* | 9/2011 | Baeumchen | B60G 17/01908 280/5.515 |

FOREIGN PATENT DOCUMENTS

| | | |
|---|---|---|
| CN | 102009653 | 4/2011 |
| CN | 102556075 | 7/2012 |
| CN | 102673569 | 9/2012 |

* cited by examiner

APPARATUS FOR ESTIMATING LATERAL FORCES OF RAILROAD VEHICLES

The present application is based on, and claims priority from the Korean Patent Application Number 10-2014-0009343, filed on Jan. 27, 2014, the disclosure of which is incorporated by reference herein in its entirety.

BACKGROUND

Field of the Disclosure

The present disclosure relates to an apparatus and a method for estimating a lateral force of a railroad vehicle. More specifically, the present disclosure relates to an apparatus and a method for estimating a lateral force applied to a bogie caused by contact between a wheel and a rail when a railroad vehicle drives in a curved section.

Discussion of the Related Art

Information on a lateral force applied to a bogie of a railroad vehicle is a factor to determine the possibility for derailment of a train. For this reason, the lateral force is one of key factors to represent the movement of a train while driving in a curved section.

In addition, the information on a lateral force is used as a key control factor for active steering control of a railroad vehicle.

Related arts for measuring a lateral force while in a curved section are disclosed in Korean Patent Publication No. 10-2013-0055110 ("Tire lateral force estimation method and device", hereinafter referred to as "Reference 1") and U.S. Pat. No. 7,853,412 ("Estimation of wheel rail interaction forces", hereinafter referred to as "Reference 2").

Reference 1 discloses a device for detecting a lateral force applied to a tire of an automotive vehicle. It relates to a method for detecting a lateral force applied to the tire, whereby an actual driving test is performed by a vehicle configured with a plurality of sensors, data on movement of the vehicle is collected, and the data is applied to a reference vehicle model and Kalman estimation to calculate a parameter of a tire model.

Reference 2 discloses a device for detecting a lateral force and a normal force applied between a wheel and a rail of a railroad vehicle. It relates to a method for detecting a lateral force, by constructing a railroad vehicle as a thirteen degree of freedom dynamics model, and calculating the lateral force and the normal force using information obtained from acceleration sensors installed in the vehicle and a lateral force and normal force model generated due to contact between a rail and a wheel.

Reference 1 discloses a method for detecting a lateral force applied to a tire of an automotive vehicle. However, the method is difficult to be directly applied to a railroad vehicle, and has an disadvantage of requiring a complex tire model.

Furthermore, the technique for detecting a lateral force using a tire model requires an accuracy of the tire model. Thus, the estimated value is dependent on accuracy of the tire model.

In addition, reference 2 discloses a method for detecting a lateral force and a normal force of a railroad vehicle. However, the method is based on a mathematical model with respect to a lateral force. Thus, the method has a disadvantage in that the estimated lateral force is dependent on accuracy of such mathematical model.

SUMMARY OF THE DISCLOSURE

In order to overcome the problems of conventional arts, the present disclosure provides an apparatus and a method for estimating lateral forces applied to front and rear bogies of a railroad vehicle by using a dynamics model for a body of the railroad vehicle and data measure by sensors, without any complex mathematical model for the lateral force.

In a general aspect of the present disclosure, an apparatus for estimating a lateral force of a railroad vehicle is provided, the apparatus comprising: a lateral velocity estimation observer configured to calculate a lateral velocity estimate by estimating a lateral velocity based on a vertical acceleration, a lateral acceleration, a yaw velocity, and a wheel angular velocity of the railroad vehicle; and a lateral force estimation observer configured to calculate a lateral force estimate, by estimating a lateral force applied to a bogie of the railroad vehicle based on a steering angle of the railroad vehicle, a vertical force applied to the railroad vehicle, and a lateral velocity estimate calculated by the lateral velocity estimation observer.

In some exemplary embodiments of the present disclosure, the lateral velocity estimation observer may include: a vertical velocity calculator configured to calculate a vertical velocity of the railroad vehicle based on a front wheel angular velocity and a rear wheel angular velocity measured by a wheel sensor; and a lateral velocity estimator configured to calculate the lateral velocity estimate based on the vertical acceleration, the lateral acceleration, and the yaw velocity measured by a body sensor, and based on a vertical velocity calculated by the vertical velocity calculator.

In some exemplary embodiments of the present disclosure, the lateral velocity estimation observer may calculate the lateral velocity estimate using a Kalman filter, and the lateral force estimation observer may calculate the lateral force estimate using an extended Kalman filter.

In another general aspect of the present disclosure, a method for estimating a lateral force of a railroad vehicle is provided, the method comprising: calculating a vertical velocity by using a front wheel angular velocity and a rear wheel angular velocity of the railroad vehicle; calculating a lateral velocity estimate by applying a vertical acceleration, a lateral acceleration, and a yaw velocity of the railroad vehicle, and the vertical velocity to a Kalman filter; and calculating a lateral force estimate, by estimating a lateral force applied to a bogie of the railroad vehicle by applying a steering angle of the railroad vehicle, a vertical force applied to a wheel of the railroad vehicle, and the lateral velocity estimate to an extended Kalman filter.

According to an exemplary embodiment of the present disclosure, lateral forces applied to front and rear bogies of a railroad vehicle may be estimated by using a dynamics model for a body of the railroad vehicle and data measure by sensors, without any complex mathematical model for the lateral force.

DETAILED DESCRIPTION

Figure 1:
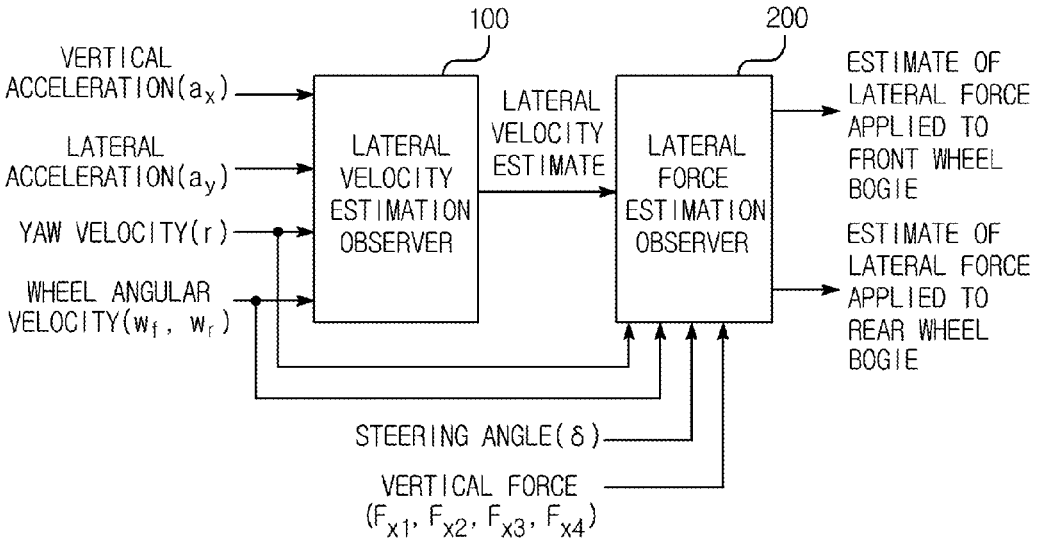
FIG. 1 is a block diagram illustrating an apparatus for estimating lateral force of a railroad vehicle according to an exemplary embodiment of the present disclosure.

Hereinafter, referring to enclosed figures, exemplary embodiment of the present disclosure will be described in detail so that persons skilled in the art may make and use the same. The thickness of lines and the size of components illustrated in the drawings may be exaggerated herein for clear and convenient description. In addition, terms to be mentioned in the following are defined in consideration of functions in the present disclosure, which may be varied according to the intention of a user or an operator, or practical customs. Therefore, the definition of the terms shall be made based on the overall contents of the present disclosure.

Figure 2:
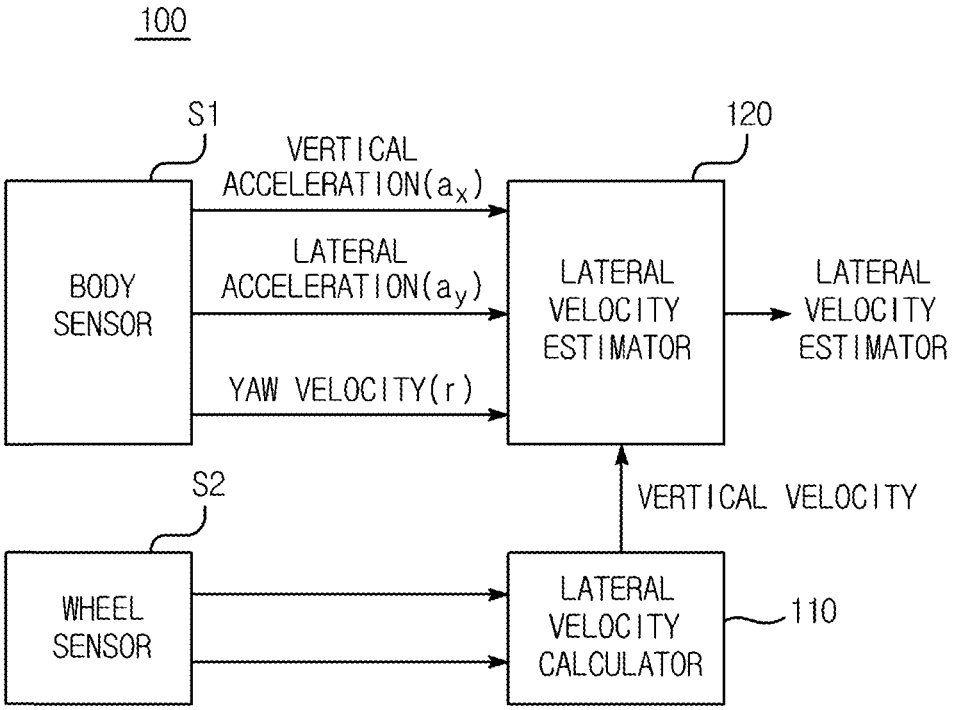
FIG. 2 is a block diagram illustrating a lateral velocity estimator of an apparatus for estimating lateral force of a railroad vehicle according to an exemplary embodiment of the present disclosure.
Figure 3:
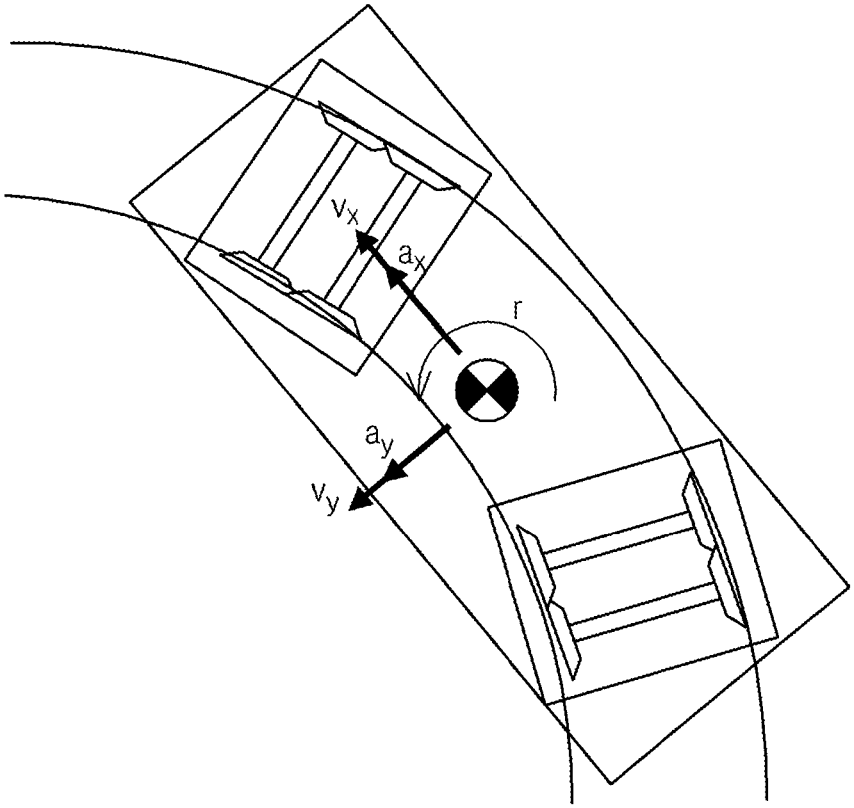
FIG. 3 is a view illustrating a vehicle model where a railroad vehicle drives in a curved section.
Figure 4:
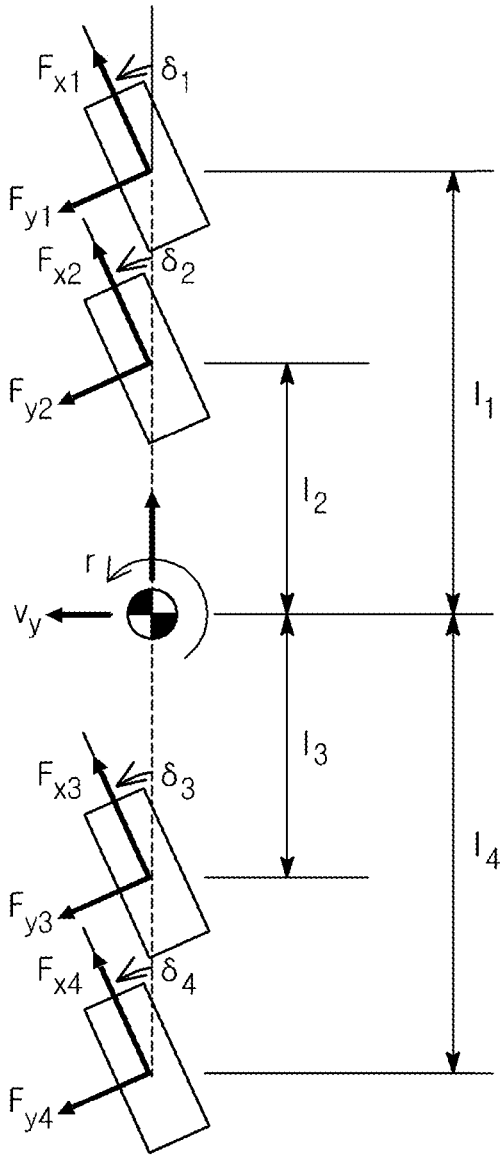
FIG. 4 is a view illustrating a bicycle model for a lateral model of a railroad vehicle.

FIG. 1 is a block diagram illustrating an apparatus for estimating lateral force of a railroad vehicle according to an exemplary embodiment of the present disclosure; FIG. 2 is a block diagram illustrating a lateral velocity estimator of an apparatus for estimating lateral force of a railroad vehicle according to an exemplary embodiment of the present disclosure; FIG. 3 is a view illustrating a vehicle model where a railroad vehicle drives in a curved section; and FIG. 4 is a view illustrating a bicycle model for a lateral model of a railroad vehicle.

Referring to FIG. 1, an apparatus for estimating a lateral force of a railraod vehicle according to an exemplary embodiment of the present disclosure may include a lateral velocity estimation observer (100) and a lateral force estimation observer (200).

The lateral velocity estimation observer (100) may calculate a lateral velocity estimate by estimating a lateral velocity based on a vertical acceleration ($a_x$), a lateral acceleration ($a_y$), a yaw velocity (r), and a wheel angular velocity ($\omega_f$, $\omega_r$) of a railroad vehicle.

Here, referring to FIG. 2, the lateral velocity estimation observer (100) may include a vertical velocity calculator (110) configured to calculate a vertical velocity of a railroad vehicle based on a front wheel angular velocity ($\omega_f$) and a rear wheel angular velocity ($\omega_r$) measured by a wheel sensor (S1), and a lateral velocity estimator (120) configured to calculate a lateral velocity estimate based on the vertical acceleration, the lateral acceleration, and the yaw velocity measured by a body sensor (S2), and based on a vertical velocity calculated by the vertical velocity calculator (110).

Meanwhile, the lateral force estimation observer (200) may calculate a lateral force estimate by estimating a lateral force applied to a bogie based on a steering angle (δ), a vertical force applied of wheels ($Fx_1$, $Fx_2$, $Fx_3$, $Fx_4$), and a lateral velocity estimate calculated by the lateral velocity estimation observer (100).

As described in the above, the lateral velocity estimation observer (100) calculates a lateral velocity estimate. Hereinafter, the method for calculate a lateral velocity estimate will be described in detail.

Kinetic dynamics in a center of the railroad vehicle illustrated in FIG. 3 may be represented by Equation 1 as in the following.

$$\dot{v}_x - v_y r = a_x$$

$$\dot{v}_y + v_x r = a_y, \qquad \text{[Equation 1]}$$

where $v_x$ and $v_y$ are a vertical velocity and a lateral velocity in a mass center of a railroad vehicle, respectively, r is a yaw velocity, and $a_x$ and $a_y$ are a vertical acceleration and a lateral acceleration.

The above Equation 1 may be represented as a state as in the following Equation 2.

$$\begin{bmatrix} \dot{v}_x \\ \dot{v}_y \end{bmatrix} = \begin{bmatrix} O & r \\ r & O \end{bmatrix} \begin{bmatrix} v_x \\ v_y \end{bmatrix} + \begin{bmatrix} a_x \\ a_y \end{bmatrix} \qquad \text{[Equation 2]}$$

In addition, when Equation 2 is represented as a discretization equation assuming that a disturbance exists in a system, the Equation 2 may be represented as the following Equation 3.

$$x(k) = A(k-1) \cdot x(k-1) + B(k-1) \cdot u(k-1) + w_d(k-1) \qquad \text{[Equation 3]}$$

$$y(k) = C(k) \cdot x(k) + w_v(k),$$

where $$x(k) = \begin{bmatrix} v_x(k) \\ v_y(k) \end{bmatrix}$$

$$A(k-1) = \begin{bmatrix} 1 & \Delta T \cdot r(k-1) \\ -\Delta T \cdot r(k-1) & 1 \end{bmatrix}$$

$$B(k-1) = \Delta T$$

$$u(k-1) = \begin{bmatrix} a_x(k-1) \\ a_y(k-1) \end{bmatrix},$$

ΔT is a measurement interval (step size), $w_d(k-1)$ and $w_v(k)$ represents a disturbance applied to a system in k−1th step and a sensor noise applied to an output in kth step, respectively.

In addition, assuming that a vertical velocity in a mass center of a railroad vehicle can be measured, the Equation 2 may be presented as Equation 4 in the following.

$$y(k) = v_x(k)$$

$$C(k) = [1\ 0] \qquad \text{[Equation 4]}$$

The vertical velocity in a mass center of a railroad vehicle can be measured from a front wheel angular velocity and a rear wheel angular velocity. That is, a vertical velocity ($v_x(k)$) of a railroad vehicle may be calculated as an average of a front wheel angular velocity and a rear wheel angular velocity, as in the following Equation 5.

$$v_x(k) = \frac{\omega_f(k) + \omega_y(k)}{2} \times \frac{D}{2}, \qquad \text{[Equation 5]}$$

where $\omega_f(k)$ and $\omega_r(k)$ represent a front wheel angular velocity and a rear wheel angular velocity in kth step, respectively, and D represents a diameter of the wheel.

Therefore, the vertical velocity calculator (110) may calculate a vertical velocity of a railroad vehicle using a front wheel angular velocity and a rear wheel angular velocity measured by the wheel sensor (S2), based on the above Equation 5.

A linear observer is used to estimate a lateral velocity in a mass center of a railroad vehicle and there are various kinds of observers to estimate a state variable in a linear system. In the present exemplary embodiment, the lateral velocity estimator (120) is designed using a Kalman filter.

A linear Kalman filter to estimate a lateral velocity can be designed as in the following.

At first, a state variable estimate is estimated according to the following Equation 6.

$$\hat{x}(k|k-1) = A(k-1)\hat{x}(k-1|k-1) + B(k-1)u(k-1), \text{[Equation 6]}$$

where $\hat{x}(k-1|k-1)$ is a state variable estimate in k−1th step, u(k−1) is an input estimate in k−1th step, and $\hat{x}(k|k-1)$ is a kth state variable value predicted by using a state value estimate in k−1th step, an input measurement value in k−1th step, etc.

Successively, an error covariance is estimated using the following Equation 7.

$$P(k|k-1)=A(k-1)P(k-1|k-1)A^T(k-1)+Q(k-1), \quad \text{[Equation 7]}$$

where P(k−1|k−1) is an error covariance estimate, wherein the estimation error is defined as a difference between an actual state variable and an estimated state variable. In addition, Q(k−1) is a covariance of $w_d(k-1)$ which is a disturbance applied to a system. P(k|k−1) is an estimation error covariance of a state variable predicted in kth step by using a covariance of a system matrix and a disturbance, and an estimation error covariance value in the previous step.

Next, a Kalman filter gain is calculated using the following Equation 8.

$$K(k)=P(k|k-1)C^T(k)(C(k)P(k|k-1)C^T(k)+R(k))^{-1}, \quad \text{[Equation 8]}$$

where K(k) is a Kalman filter gain in kth step, and R(k) is a covariance of a sensor-measured noise in kth step.

Next, a state variable is calibrated using the following Equation 9.

$$\hat{x}(k|k)=\hat{x}(k|k-1)+K(k)(y(k)-C(k)\hat{x}(k|k-1)), \quad \text{[Equation 9]}$$

where y(k) is a sensor-measured value in kth step, and $\hat{x}(k|k)$ is a state variable estimate in kth step.

When you look at it, the state variable in kth step is estimated by calibrating a kth state variable estimate predicted in k−1th step using an estimation error with respect to an output variable from a value measured in kth step.

Using the state variable estimated thereby, the lateral velocity in a mass center of a railroad vehicle can be calculated according to the following Equation 10.

$$\hat{v}_y(k)=[0\ 1]\hat{x}(k|k), \quad \text{Equation 10}$$

where $\hat{v}_y(k)$ is a lateral velocity of a railroad vehicle estimated in kth step.

The lateral force estimation observer (200) according to an exemplary embodiment of the present disclosure calculates a lateral force estimate. Hereinafter, a method for calculation the lateral force estimate will be specifically described.

FIG. 4 is a view illustrating the railroad vehicle model of FIG. 3 as a bicycle model. The railroad vehicle model can be simplified as a bicycle model; because it can be assumed that forces applied to a left wheel and a right wheel of a railroad vehicle are almost the same when the railroad vehicle is driving in a curved section. An exemplary case where there are four of the railroad vehicles will be described.

Railroad vehicle dynamics models of the bicycle model illustrated in FIG. 4 in a vertical direction, a lateral direction, and a yaw direction are as in the following Equations 11 to 13, respectively.

$$m(\dot{v}_x-v_y r)=\Sigma F_x \quad \text{[Equation 11]}$$

$$m(\dot{v}_y-v_x r)=\Sigma F_y \quad \text{[Equation 12]}$$

$$I_z\dot{r}=\Sigma M_z, \quad \text{[Equation 13]}$$

where $\Sigma F_x$ is a sum of forces applied to vertical directions of each railroad vehicle, $\Sigma F_y$ is a sum of forces applied to lateral directions of each railroad vehicle, $\Sigma F_z$ is a sum of forces applied to yaw directions of each railroad vehicle, and a sum of each force ($\Sigma F_x$, $\Sigma F_y$, $\Sigma F_z$) can be calculated according to the following Equation 14.

$$\sum F_x = \sum_{i=1}^{4} (F_{xi}\cos\delta_i - F_{yi}\sin\delta_i), \quad \text{[Equation 14]}$$

$$\sum F_y = \sum_{i=1}^{4} (F_{xi}\sin\delta_i + F_{yi}\cos\delta_i),$$

$$\sum M_z = \sum_{i=1}^{2} l_i(F_{xi}\sin\delta_i + F_{yi}\cos\delta_i) - \sum_{i=3}^{4} l_i(F_{xi}\sin\delta_i + F_{yi}\cos\delta_i)$$

When a railroad vehicle drives in a curved section, the railroad vehicle drives on a track of which curvature is constant. Thus, it can be assumed that front wheels of each railroad vehicle are steered at the same angle and rear wheels are steered at the same angle in an opposite direction. Therefore, the steering angle can be assumed as in the following Equation 15.

$$\delta_1=\delta_2=\delta$$

$$\delta_3=\delta_4=-\delta \quad \text{[Equation 15]}$$

Therefore, when applying Equations 14 and 15 to Equations 11 to 13, the following Equation 16 can be obtained.

$$\dot{v}_x = v_y r + \frac{1}{m}[\cos\delta(F_{x1} + F_{x2} + F_{x3} + F_{x4}) - \sin\delta(F_{y1} + F_{y2} - F_{y3} - F_{y4})], \quad \text{[Equation 16]}$$

$$\dot{v}_y = -v_x r + \frac{1}{m}[\cos\delta(F_{y1} + F_{y2} + F_{y3} + F_{y4}) + \sin\delta(F_{x1} + F_{x2} - F_{x3} - F_{x4})],$$

$$\dot{r} = \frac{1}{I_z}[\cos\delta(l_1F_{y1} + l_2F_{y2} - l_3F_{y3} - l_4F_{y4}) + \sin\delta(l_1F_{x1} + l_2F_{x2} + l_3F_{x3} + l_4F_{x4})]$$

A lateral force applied to a front bogie of a railroad vehicle is a sum of lateral forces applied to both front wheels, and a lateral force applied to a rear bogie of a railroad vehicle is a sum of lateral forces applied to both rear wheels. Thus, the lateral forces applied to front and rear bogies can be defined as in the following Equation 17.

$$l_fF_{yf}=l_1F_{y1}+l_2F_{y2}$$

$$l_rF_{yr}=l_3F_{y3}+l_4F_{y4}, \quad \text{[Equation 17]}$$

where $l_f$ is a length in a vertical direction from a center of the railroad vehicle to a front wheel bogie, $l_r$ is a length in a vertical direction from a center of the railroad vehicle to a rear wheel bogie, $F_{yf}$ is a lateral force applied to a front wheel bogie, and $F_{yr}$. is a lateral force applied to a rear wheel bogie. In addition, $l_1$ is a length in a vertical direction from a center of the railroad vehicle to a first front wheel, $l_2$ is a length in a vertical direction from a center of the railroad vehicle to a second front wheel, $F_{y1}$ is a lateral force applied to a first front wheel, and $F_{y2}$ is a lateral force applied to a second front wheel. Likewise, $l_3$ is a length in a vertical direction from a center of the railroad vehicle to a first rear wheel, $l_4$ is a length in a vertical direction from a center of the railroad vehicle to a second rear wheel, $F_{y3}$ is a lateral force applied to a first rear wheel, and $F_{y4}$ is a lateral force applied to a second rear wheel.

When substituting the above Equation 17 to Equation 15, the following Equation 18 can be derived.

$$\begin{bmatrix}\dot{v}_x\\ \dot{v}_y\\ \dot{r}\end{bmatrix}=\begin{bmatrix}v_y r-\frac{1}{m}\sin\delta(F_{yf}-F_{yr})\\ -v_x r+\frac{1}{m}\cos\delta(F_{yf}+F_{yr})\\ \frac{1}{I_z}\cos\delta(l_f F_{yf}-l_y F_{yr})\end{bmatrix}+\begin{bmatrix}\frac{1}{m}\cos\delta(F_{x1}+F_{x2}=F_{x3}+F_{x4})\\ \frac{1}{m}\sin\delta(F_{x1}+F_{x2}-F_{x3}-F_{x4})\\ \frac{1}{I_z}\sin\delta(l_1F_{x1}+l_2F_{x2}+l_3F_{x3}+l_4F_{x4})\end{bmatrix}$$ [Equation 18]

In order to represent Equation 18 as a state equation, state variables are defined as in Equation 19.

$$X_1=v_x$$
$$X_2=v_y$$
$$X_3=r$$
$$X_4=F_{yf}$$
$$X_5=F_{yr}$$ [Equation 19]

In addition, when assuming that the values of lateral forces applied to front and rear wheel bogie change slowly, the lateral forces can be assumed to be almost constant. Thus, the differential value of the lateral force can be assumed to be zero (0).

$$\dot{F}yf=\dot{F}yr=0$$ [Equation 20]

When representing Equation 18 again using Equations 19 and 20, the following Equation 21 can be derived.

$$\begin{bmatrix}\dot{X}_1\\ \dot{X}_2\\ \dot{X}_3\\ \dot{X}_4\\ \dot{X}_5\end{bmatrix}=\begin{bmatrix}X_2X_3-\frac{1}{m}\sin\delta(X_4-X_5)\\ -X_1X_3+\frac{1}{m}\cos\delta(X_4+X_5)\\ \frac{1}{I_z}\cos\delta(l_fX_4-l_rX_5)\\ 0\\ 0\end{bmatrix}+\begin{bmatrix}\frac{1}{m}\cos\delta(F_{x1}+F_{x2}+F_{x3}+F_{x4})\\ \frac{1}{m}\sin\delta(F_{x1}+F_{x2}-F_{x3}-F_{x4})\\ \frac{1}{I_z}\sin\delta(l_1F_{x1}+l_2F_{x2}+l_3F_{x3}+l_4F_{x4})\\ 0\\ 0\end{bmatrix}$$ [Equation 21]

When discretizing Equation 21, it can be represented as in the following Equation 22.

$$\begin{bmatrix}X_1(k)\\ X_2(k)\\ X_3(k)\\ X_4(k)\\ X_5(k)\end{bmatrix}=$$ [Equation 22]

-continued $$\begin{bmatrix}X_1(k-1)+\Delta T\begin{bmatrix}X_2(k-1)X_3(k-1)-\\ \frac{1}{m}\sin\delta(k-1)\begin{pmatrix}X_4(k-1)-\\ X_5(k-1)\end{pmatrix}\end{bmatrix}\\ X_2(k-1)+\Delta T\begin{bmatrix}-X_1(k-1)X_3(k-1)+\\ \frac{1}{m}\cos\delta(k-1)\begin{pmatrix}X_4(k-1)-\\ X_5(k-1)\end{pmatrix}\end{bmatrix}\\ X_3(k-1)+\Delta T\left[\frac{1}{I_z}\cos\delta(k-1)\begin{pmatrix}l_fX_4(k-1)-\\ l_rX_5(k-1)\end{pmatrix}\right]\\ X_4(k-1)\\ X_5(k-1)\end{bmatrix}+\begin{bmatrix}\frac{1}{m}\cos\delta(k-1)\begin{pmatrix}F_{x1}(k-1)+F_{x2}(k-1)+\\ F_{x3}(k-1)+F_{x4}(k-1)\end{pmatrix}\\ \frac{1}{m}\sin\delta(k-1)\begin{pmatrix}F_{x1}(k-1)+F_{x2}(k-1)-\\ F_{x3}(k-1)-F_{x4}(k-1)\end{pmatrix}\\ \frac{1}{I_z}\sin\delta(k-1)\begin{pmatrix}l_1F_{x1}(k-1)+l_2F_{x2}(k-1)+\\ l_3F_{x3}(k-1)+l_4F_{x4}(k-1)\end{pmatrix}\\ 0\\ 0\end{bmatrix}+w_d(k-1)$$

Assuming that a disturbance exists in the system and a sensor noise occurs when measured, when redefining Equation 22 as a state equation, it can be represented as in the following Equation 23.

$$X(k)=f(X(k-1),U(k-1))+w_d(k-1)$$ [Equation 23]

$$Y(k)=h(X(k))+w_v(k),$$

where $$X(k)=\begin{bmatrix}X_1(k)\\ X_2(k)\\ X_3(k)\\ X_4(k)\\ X_5(k)\end{bmatrix},$$

$$f(X(k-1),U(k-1))=$$

$$\begin{bmatrix}X_1(k-1)+\Delta T\begin{bmatrix}X_2(k-1)X_3(k-1)-\\ \frac{1}{m}\sin\delta(k-1)\begin{pmatrix}X_4(k-1)-\\ X_5(k-1)\end{pmatrix}\end{bmatrix}\\ X_2(k-1)+\Delta T\begin{bmatrix}-X_1(k-1)X_3(k-1)+\\ \frac{1}{m}\cos\delta(k-1)\begin{pmatrix}X_4(k-1)+\\ X_5(k-1)\end{pmatrix}\end{bmatrix}\\ X_3(k-1)+\Delta T\left[\frac{1}{I_z}\cos\delta(k-1)\begin{pmatrix}l_fX_4(k-1)-\\ l_rX_5(k-1)\end{pmatrix}\right]\\ X_4(k-1)\\ X_5(k-1)\end{bmatrix}+$$

-continued $$\begin{bmatrix} \frac{1}{m}\cos\delta(k-1)\begin{pmatrix} F_{x1}(k-1)+F_{x2}(k-1)+ \\ F_{x3}(k-1)+F_{x4}(k-1) \end{pmatrix} \\ \frac{1}{m}\sin\delta(k-1)\begin{pmatrix} F_{x1}(k-1)+F_{x2}(k-1)- \\ F_{x3}(k-1)-F_{x4}(k-1) \end{pmatrix} \\ \frac{1}{I_z}\sin\delta(k-1)\begin{pmatrix} l_1F_{x1}(k-1)+l_2F_{x2}(k-1)+ \\ l_3F_{x3}(k-1)+l_4F_{x4}(k-1) \end{pmatrix} \\ 0 \\ 0 \end{bmatrix},$$

$$h(X(k)) = \begin{bmatrix} v_x(k) \\ \hat{v}_y(k) \\ r(k) \end{bmatrix},$$

$w_d(k-1)$ is a disturbance applied to the system, and $w_v(k)$ is a measured noise.

As confirmed in the above Equation 23, a vertical velocity, a lateral velocity, and a yaw velocity which are applying in a center of the railroad vehicle, and lateral forces applied to front and rear wheel bogies are defined as state variables. In addition, a vertical velocity in a mass center of the railroad vehicle, a lateral velocity estimated in a mass center of the railroad vehicle, and a yaw velocity in a mass center of the railroad vehicle are defined as measurement variables.

An extended Kalman filter is used as the lateral force estimation observer (200) in an exemplary embodiment of the present disclosure. However, this is an example for describing the present disclosure. Thus, it will be apparent to those skilled in the art of the present disclosure that other types of observers may be used for estimating a lateral force applied to a bogie of a railroad vehicle.

State variable values for estimating a lateral force applied to a bogie using the extended Kalman filter can be calculated by the following Equation 24.

$$\hat{X}(k|k-1)=f(\hat{X}(k-1|k-1),U(k-1)), \quad \text{[Equation 24]}$$

where $\hat{X}(k-1|k-1)$ is a state variable estimate in k−1th step, U(k−1) is an input measurement value in k−1th step. In addition, $\hat{X}(k|k-1)$ is a kth state variable value predicted by using a state value estimate in k−1th step, an input measurement value in k−1th step, etc.

Meanwhile, a estimation error covariance of a state variable predicted in kth step (P(k|k−1)) can be obtained by the following Equation 25.

$$P(k|k-1)=F(k-1)P(k-1|k-1)F(k-1)^T+Q(k-1), \quad \text{[Equation 25]}$$

where $$F(k) = \frac{\partial f(X(k), U(k))}{\partial X(k)},$$

which is defined as a Jacobian matrix with respect to X(k) of a function f(X(k), U(k)).

In addition, P(k−1|k−1) is an estimated error covariance estimate in k−1th step, and the estimated error is defined as a difference between an actual state variable and an estimated state variable. In addition, Q(k−1) is a covariance of $w_d(k-1)$ which is a disturbance applied to the system, and P(k|k−1) is an estimated error covariance of a state variable predicted in kth step by using a system matrix, a covariance of a disturbance, and an estimated error covariance value of a state variable predicted in the previous step.

Meanwhile, a measurement variable value can be estimated based on the state variable value calculated by Equation 24, according to the following Equation 26.

$$\hat{Y}(k|k-1)=h(\hat{X}(k|k-1)) \quad \text{[Equation 26]}$$

In addition, a Kalman filter gain in kth step (L(k)) can be calculated by the following Equation 27.

$$L(k)=P(k|k-1)H(k)^T(H(k)P(k|k-1)H(k)^T+R(k))^{-1}, \quad \text{[Equation 27]}$$

where R(k) is a covariance of a sensor-measured noise in kth step.

In addition, a state variable estimate can be calculated by the following Equation 28.

$$\hat{X}(k|k)=f(\hat{X}(k|k-1),U(k-1))+L(k)(Y(k)-\hat{Y}(k|k-1)), \quad \text{[Equation 28]}$$

where Y(k) is a sensor-measured value in kth step, and $\hat{X}(k|k)$ is a state variable estimate in kth step.

When you look at it, the state variable in kth step is estimated by calibrating a kth state variable estimate predicted in k−1 th step using an estimation error with respect to an output variable from a value measured in kth step.

In addition, an estimated covariance (P(k|k) updated by using an estimated error covariance of a state variable value predicted by Equation 25 and a Kalman filter gain calculated by Equation 27 can be calculated according to the following Equation 29.

$$P(k|k)=(I-L(k)H(k))P(k|k-1), \quad \text{[Equation 29]}$$

where $$H(k) = \frac{\partial h(X(k))}{\partial X(k)},$$

which is defined as a Jacobian matrix with respect to X(k) of a function h(X(k)).

Meanwhile, a state variable can be estimated by using an extended Kalman filter defined in Equations 24 to 29. In addition, lateral forces applied to front and rear wheel bogies of a railroad vehicle can be estimated by using a state variable value estimated in kth step ($\hat{X}(k|k)$, as in the following Equation 30.

$$\begin{bmatrix} \hat{F}_{yf}(k) \\ \hat{F}_{yr}(k) \end{bmatrix} = \begin{bmatrix} 0 & 0 & 0 & 1 & 0 \\ 0 & 0 & 0 & 0 & 1 \end{bmatrix} \hat{X}(k \mid k) \quad \text{[Equation 30]}$$

where $\hat{X}(k|k)$ is a state variable estimate in kth step, $\hat{F}_{yf}(k)$ is an estimate of a lateral force applied to a front wheel bogie in kth step, and $\hat{F}_{yr}(k)$ is an estimate of a lateral force applied to a rear wheel bogie in kth step.

Meanwhile, although an apparatus and a method for estimating a lateral force of a railroad vehicle according to exemplary embodiments of the present disclosure have been described in the above, however, the scope of the present disclosure is not limited by the embodiments described above. Therefore, the present disclosure may be alternatively performed in various transformation or modifications within the limit such that the differences are obvious to persons having ordinary skill in the art to which the present disclosure pertains.

Therefore, the abovementioned exemplary embodiments and enclosed figures are intended to be illustrative, and not to limit the scope of the claims. The scope of protection of the present disclosure is to be interpreted by the following claims, and that all the technical ideas within the equivalent scope of the scope of the present disclosure should be construed as being included.

What is claimed is:

1. An apparatus for estimating a lateral force of a railroad vehicle, the apparatus comprising:

a lateral velocity estimation observer configured to calculate a lateral velocity estimate by estimating a lateral velocity based on a vertical acceleration, a lateral acceleration, a yaw velocity, and a wheel angular velocity of the railroad vehicle; and a lateral force estimation observer configured to calculate a lateral force estimate by estimating a lateral force applied to a bogie of the railroad vehicle based on a steering angle of the railroad vehicle, a vertical force applied to the railroad vehicle, and a lateral velocity estimate calculated by the lateral velocity estimation observer, wherein the lateral velocity estimation observer includes:

a vertical velocity calculator configured to calculate a vertical velocity of the railroad vehicle by averaging a front wheel angular velocity and a rear wheel angular velocity measured by a wheel sensor; and a lateral velocity estimator configured to calculate the lateral velocity estimate based on the vertical acceleration, the lateral acceleration, and the yaw velocity measured by a body sensor and further based on a vertical velocity calculated by the vertical velocity calculator.

2. The apparatus of claim 1, wherein:

the lateral velocity estimation observer calculates the lateral velocity estimate using a Kalman filter; and the lateral force estimation observer calculates the lateral force estimate using an extended Kalman filter.

3. The apparatus of claim 1, wherein the lateral velocity estimate ($\hat{v}_y(k)$) is calculated by the following equation:

$$\hat{v}_y(k)=[0\ 1]\hat{x}(k|k),$$

where $\hat{v}_y(k)$ is a lateral velocity estimate of the railroad vehicle estimated in kth step and $\hat{x}(k|k)$ is a state variable estimate in kth step.

4. The apparatus of claim 1, wherein the lateral force estimate ($\hat{F}_{yf}(k),\hat{F}_{yr}(k)$) is calculated by the following equation:

$$\begin{bmatrix} \hat{F}_{yf}(k) \\ \hat{F}_{yr}(k) \end{bmatrix} = \begin{bmatrix} 0 & 0 & 0 & 1 & 0 \\ 0 & 0 & 0 & 0 & 1 \end{bmatrix} \hat{X}(k \mid k),$$

where $\hat{X}(k|k)$ is a state variable estimate in kth step, $\hat{F}_{yf}(k)$ is an estimate of lateral force applied to a front wheel bogie in kth step, and $\hat{F}_{yr}(k)$ is an estimate of lateral force applied to a rear wheel bogie in kth step.

5. A method for estimating a lateral force of a railroad vehicle, the method comprising:

calculating a vertical velocity estimate by estimating a lateral velocity based on a vertical acceleration, a lateral acceleration, a yaw velocity and a wheel angular velocity of the railroad vehicle;

and calculating a lateral force estimate by estimating a lateral force applied to a bogie of the railroad vehicle based on a steering angle of the railroad vehicle, a vertical force applied to the railroad vehicle, and a lateral velocity estimate, wherein the lateral velocity estimate is calculated by a lateral velocity estimation observer that includes:

a vertical velocity calculator configured to calculate a vertical velocity of the railroad vehicle by averaging a front wheel angular velocity and a rear wheel angular velocity measured by a wheel sensor; and a lateral velocity estimator configured to calculate the lateral velocity estimate based on the vertical acceleration, the lateral acceleration, and the yaw velocity measured by a body sensor and further based on a vertical velocity calculated by the vertical velocity calculator.

6. The method of claim 5, wherein the lateral velocity estimate is calculated by using a state variable estimated in kth step calibrated by using an estimation error with respect to an output variable between a kth state variable estimate predicted in k−1th step and a value measured in kth step, as in the following equation:

$$\hat{v}_y(k)=[0\ 1]\hat{x}(k|k),$$

where $\hat{v}_y(k)$ is a lateral velocity estimate of the railroad vehicle estimated in kth step; and $\hat{x}(k|k)$ is a state variable estimate in kth step.

7. The method of claim 5, wherein the lateral force estimate is calculated by calculating an estimate of lateral force applied to a front wheel bogie and an estimate of lateral force applied to a rear wheel bogie in kth and by applying a state variable estimate in kth step to the following equation:

$$\begin{bmatrix} \hat{F}_{yf}(k) \\ \hat{F}_{yr}(k) \end{bmatrix} = \begin{bmatrix} 0 & 0 & 0 & 1 & 0 \\ 0 & 0 & 0 & 0 & 1 \end{bmatrix} \hat{X}(k \mid k),$$

where $\hat{X}(k|k)$ is a state variable estimate in kth step, $\hat{F}_{yf}(k)$ is an estimate of lateral force applied to a front wheel bogie in kth step, and $\hat{F}_{yr}(k)$ is an estimate of lateral force applied to a rear wheel bogie in kth step.

* * * * *